US007980218B2

(12) United States Patent
Tsubouchi

(10) Patent No.: US 7,980,218 B2
(45) Date of Patent: Jul. 19, 2011

(54) PUMP DRIVING DEVICE IN ENGINE

(75) Inventor: Masanori Tsubouchi, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 1016 days.

(21) Appl. No.: 11/806,073

(22) Filed: May 29, 2007

(65) Prior Publication Data

US 2008/0000309 A1 Jan. 3, 2008

(30) Foreign Application Priority Data

May 30, 2006 (JP) ..... 2006-149613
May 30, 2006 (JP) ..... 2006-149614

(51) Int. Cl.
*F04B 9/04* (2006.01)

(52) U.S. Cl. ..... 123/185.1; 123/195 P; 123/406.58; 123/612; 123/617; 417/223; 417/319; 464/103

(58) Field of Classification Search ..... 123/41.47, 123/446, 508, 528, 406.58, 406.59, 406.62, 123/406.63, 612, 617; 417/223, 319, 316; 464/102, 103
See application file for complete search history.

(56) References Cited

U.S. PATENT DOCUMENTS 3,927,954 A * 12/1975 Walker ..... 417/360
4,272,224 A * 6/1981 Kabele ..... 417/360
4,300,872 A * 11/1981 Brown et al. ..... 417/360
5,433,108 A * 7/1995 Sawada ..... 73/114.27
5,975,970 A * 11/1999 Daikoku ..... 440/88 L

FOREIGN PATENT DOCUMENTS

| | | | |
|---|---|---|---|
| CN | 2883734 | Y | 3/2007 |
| JP | 56-27367 | | 6/1981 |
| JP | 61-150527 | U | 9/1986 |
| JP | 03-134280 | A | 6/1991 |
| JP | 04-091311 | A | 3/1992 |
| JP | 06-117289 | A | 4/1994 |
| JP | 08-100616 | A | 4/1996 |
| JP | 2002-201979 | A | 7/2002 |
| JP | 2005-34939 | A | 2/2005 |

* cited by examiner

*Primary Examiner* — Thomas N Moulis
*Assistant Examiner* — Raza Najmuddin
(74) *Attorney, Agent, or Firm* — Arent Fox LLP

(57) ABSTRACT

In a pump driving device in an engine, driving a pump shaft of a pump mounted to an engine body by a valve-operating cam shaft supported by the engine body, a bolt is threadedly engaged with one end of the cam shaft, the bolt having a head portion in which a polygonal hole is formed, and a polygonal shaft portion is formed at one end of the pump shaft so as to be fitted into the polygonal hole. The pump shaft is driven by the cam shaft via the polygonal hole and the polygonal shaft portion. Thus, a large driving torque can be transmitted from the cam shaft to the pump shaft without reducing any effective support surface of a journal portion of the cam shaft.

10 Claims, 6 Drawing Sheets

PUMP DRIVING DEVICE IN ENGINE

RELATED APPLICATION DATA

The present invention is based upon Japanese priority application Nos. 2006-149613 and 2006-149614, which are hereby incorporated in their entirety herein by reference.

BACKGROUND OF THE INVENTION

1. Field of the Invention

The present invention relates to an improvement of a pump driving device in an engine, driving a pump shaft of a pump mounted to an engine body by a valve-operating cam shaft supported by the engine body.

2. Description of the Related Art

Such a pump driving device in an engine is already known as disclosed in Japanese Utility Model Publication No. 56-27367.

In this conventional pump driving device, a drive pin is mounted across a journal portion of a cam shaft which is supported in a bearing hole of an engine body; a notch groove is formed in a pump shaft so as to be engaged with the drive pin; and the rotation of the cam shaft is transmitted to the pump shaft via the drive pin and the notch groove. However, a mounting hole of the drive pin cannot be enlarged in the journal portion of the cam shaft in order to secure an effective support surface area of the journal portion as large as possible. Therefore, it is difficult to use a drive pin having a large diameter, and thus the conventional pump driving device is not suitable for driving a large pump suffering a heavy load.

SUMMARY OF THE INVENTION

The present invention has been achieved in view of the above problem, has an object to provide a pump driving device in an engine wherein a large driving torque can be transmitted from a cam shaft to a pump shaft without reducing an effective support surface of a journal portion of a cam shaft.

In order to achieve the above object, according to a first feature of the present invention, there is provided a pump driving device in an engine, driving a pump shaft of a pump mounted to an engine body by a valve-operating cam shaft supported by the engine body, wherein a driving member having a polygonal hole is fixedly mounted at one end of the cam shaft; and a polygonal shaft portion is formed at one end of the pump shaft so as to be fitted into the polygonal hole.

With the first feature of the present invention, the driving member having the polygonal hole is fixedly mounted at one end of the cam shaft, and the polygonal shaft portion is formed at one end of the pump shaft so as to be fitted into the polygonal hole, so that driving torque is transmitted from the cam shaft to the pump shaft via the polygonal hole and the polygonal shaft portion. Therefore, the pump shaft is driven by the cam shaft with a large torque, without reducing the effective support surface of the journal portion of the cam shaft. Further, the polygonal hole and the polygonal shaft portion have large fitting surfaces, thereby improving durability of their fitting portions.

According to a second feature of the present invention, in addition to the first feature, the driving member comprises a bolt which is threadedly engaged with the cam shaft; and the polygonal hole comprises a wrench-fitting hole which is formed in a head portion of the bolt.

With the second feature of the present invention, the bolt having a wrench hole at its head portion is used as the driving member for driving the pump shaft, and the wrench hole is also used as the polygonal hole, thereby simplifying the structure of the pump driving device to provide the pump driving device at a low cost.

According to a third feature of the present invention, there is provided a pump driving device in an engine, driving a pump shaft of a pump mounted to an engine body by a valve-operating cam shaft supported by the engine body, wherein a pulser rotor is fixedly attached to one end of the cam shaft by a bolt which passes through the pulser rotor and is threadedly engaged with the cam shaft; and the bolt and the pump shaft opposed to the bolt are provided with fitting portions, respectively, which are fitted to each other to allow a torque transmission therebetween.

With the third feature of the present invention, the bolt fixedly attaching the pulser rotor to the end of the cam shaft also serves as a joint member for coupling the cam shaft to the pump shaft, which eliminates the use of a joint member exclusively for coupling an oil pump to the cam shaft. Therefore, the oil pump can be driven by a simple structure including a smaller number of components, thereby providing a cost reduction of the driving device.

According to a fourth feature of the present invention, in addition to the third feature, the fitting portion of the bolt comprises a polygonal hole for fittingly receiving therein a wrench which is formed in a head portion of the bolt; and the fitting portion of the pump shaft comprises a polygonal shaft portion which is formed at one end of the pump shaft.

With the fourth feature of the present invention, particularly because the fitting portion of the bolt comprises the polygonal hole for fittingly receiving therein the wrench provided in the head portion of the bolt, a dedicated coupling portion for coupling together the bolt and the pump shaft is not required to be formed in the bolt, thereby further simplifying the structure of the driving device. In addition, the fitting between the polygonal hole of the bolt and the polygonal shaft portion of the pump shaft enables a transmission of a large torque therebetween, thereby improving the durability of the fitting portions.

According to a fifth feature of the present invention, in addition to the third or fourth feature, a threaded shaft portion is formed in the bolt so as to be threadedly engaged with the cam shaft so that the threaded shaft portion causes a load of the pump to act as a torque in a direction to fasten the bolt when the cam shaft rotates.

With the fifth feature of the present invention, during the operation of the pump by the cam shaft, a torque in the festinating direction constantly acts on the bolt, thereby preventing the bolt from loosening.

The engine body and the pump correspond to a cylinder head 11 and an oil pump 21, respectively, of an embodiment of the present invention, which will be described later.

The above-mentioned object, other objects, characteristics, and advantages of the present invention will become apparent from a preferred embodiment which will be described in detail below by reference to the attached drawings.

DESCRIPTION OF THE PREFERRED EMBODIMENT

Figure 1:
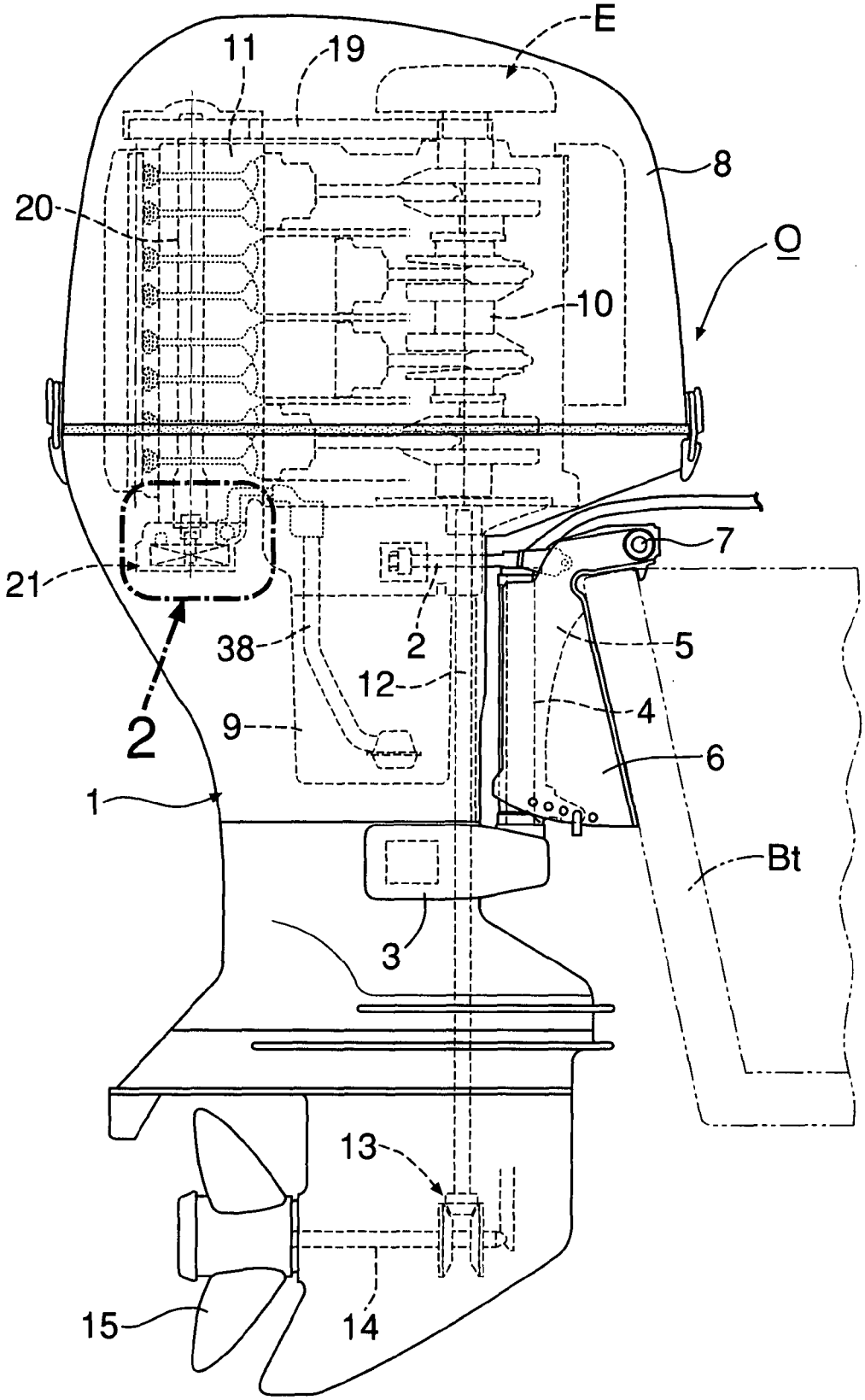
FIG. 1 is a side view of an outboard engine system which includes a pump driving device according to an embodiment of the present invention.

Referring first to FIG. 1, an outboard engine system O includes: a casing 1; a vertical swivel shaft 4 which is mounted to the casing 1 via an upper arm 2 and a lower arm 3; and a swivel case 5 coupled to a stern bracket 6 via a horizontal tilt shaft 7 so as to rotatably supporting the swivel shaft 4, the stern bracket 6 being clamped to a transom Bt of a body of a ship. Therefore, the casing 1 can be horizontally steered about the swivel shaft 4, and vertically tilted about the tilt shaft 7. A water-cooled 4-stroke engine E covered with a removable engine hood 8 is mounted on an upper part of the casing 1.

The engine E includes a vertically arranged crankshaft 10 disposed close to the swivel shaft 5, and a cylinder head 11 facing rearward. The casing 1 contains a vertically arranged output shaft 12 driven by the crankshaft 10, a horizontally arranged propeller shaft 14 driven by the output shaft 12 via a forward-reverse shifting gear mechanism 13, and a horizontally arranged propeller 15 mounted at a rear end of the propeller shaft 14 projecting from the casing 1. The casing 1 also contains an oil tank 9 which stores oil for lubricating the engine E.

The cylinder head 11 of the engine E supports a valve-operating cam shaft 20 driven by the crankshaft 10 via a timing transmission device 19 at a reduction gear ratio of 1/2, the cam shaft 20 being parallel to the crankshaft 10. An oil pump 21 driven by the cam shaft 20 is mounted in a lower portion of the cylinder head 11. The oil pump 21 draws up oil in the oil tank 9, and supplies the oil to a portion to be lubricated in the engine E.

The oil pump 21 and the devices for driving the oil pump 21 will be described below with reference to FIGS. 2 to 6.

Figure 2:
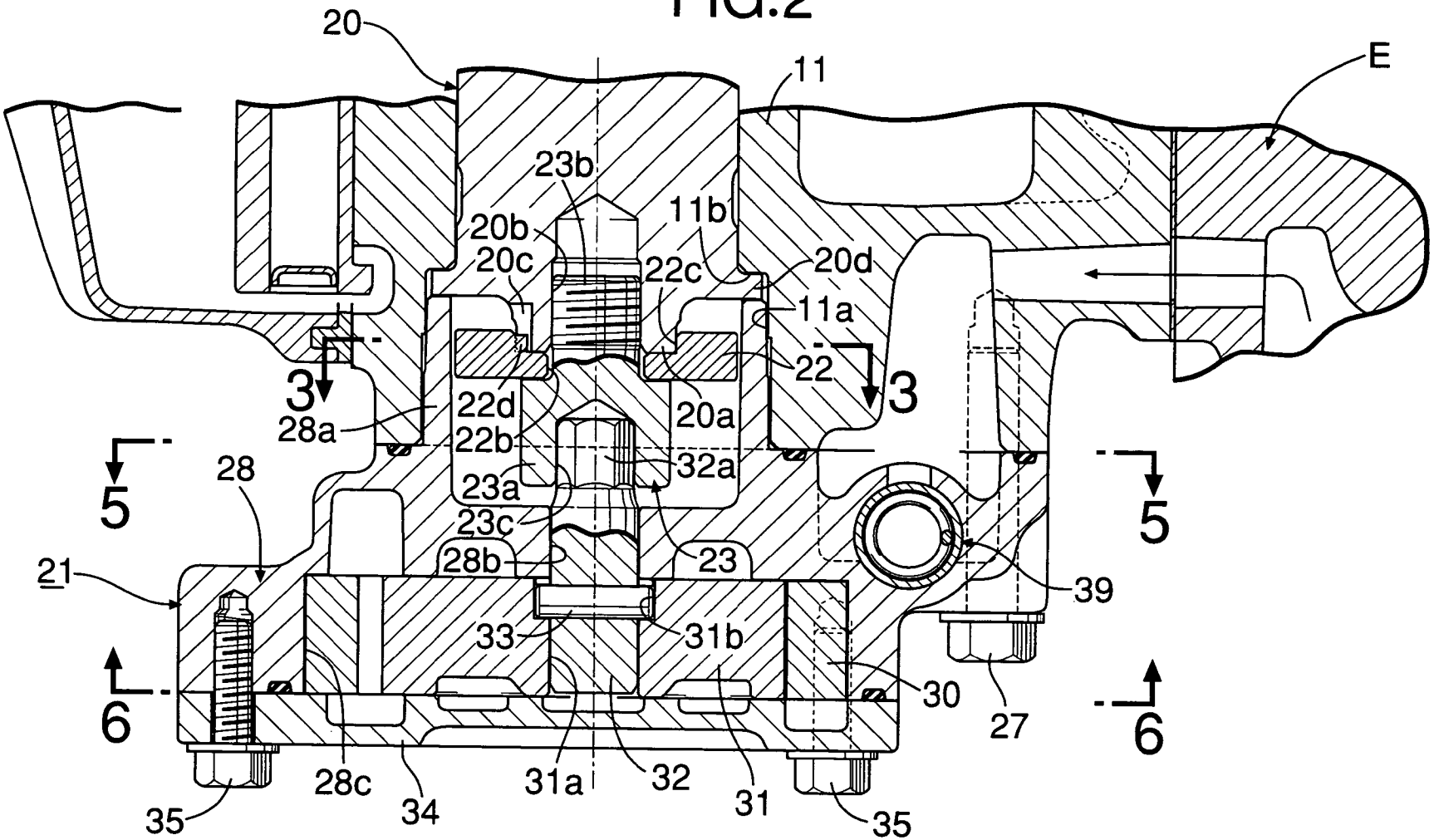
FIG. 2 is an enlarged sectional view of a portion 2 (pump driving device portion) of FIG. 1.
Figure 3:
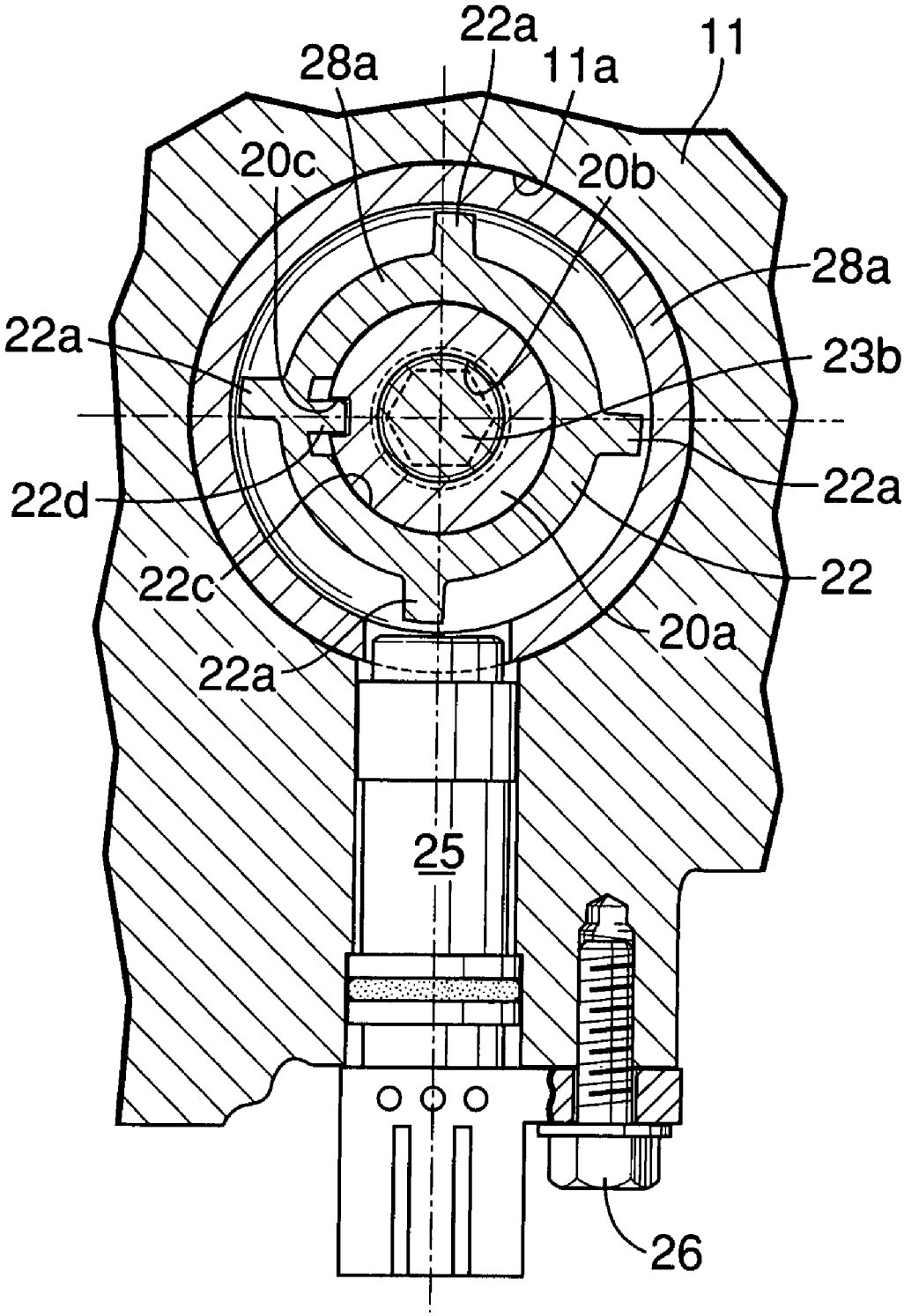
FIG. 3 is a sectional view taken along a line 3-3 of FIG. 2.
Figure 4:
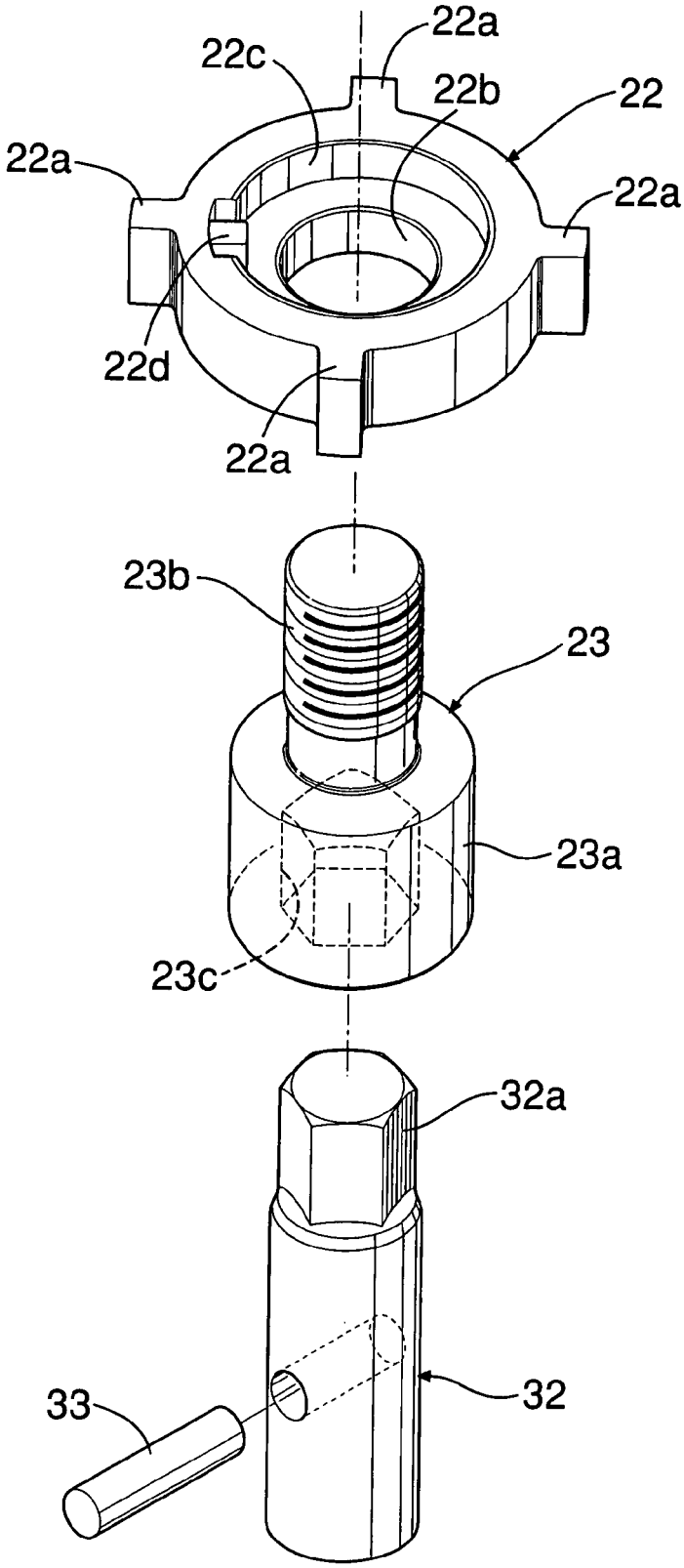
FIG. 4 is an exploded perspective view of essential portions of FIG. 2.

In FIGS. 2 to 4, a pulser rotor 22 has a plurality of projections 22*a* at predetermined positions on its outer peripheral surface, and is fixedly attached to a lower portion of the cam shaft 20 by a bolt 23, as described below. The pulser rotor 22 includes a mounting hole 22*b* at its central portion, and a positioning recess 22*c* on its upper surface so as to be coaxial with the mounting hole 22*b*. A key 22*d* is integrally projectingly provided on an inner peripheral surface of the positioning recess 22*c*. A boss 20*a* coaxial with the cam shaft 20 is integrally projectingly provided on a lower end surface of the cam shaft 20. In the boss 20*a*, a threaded bore 20*b* is formed at a central portion, and a key groove 20*c* is formed in an outer peripheral surface. A polygonal hole, preferably a hexagonal hole 23*c*, for fittingly receiving therein a wrench is provided in a head portion 23*a* of the bolt 23 such that the hole opens to the central portion of the lower end surface of the head portion 23*a*.

In securing the pulser rotor 22 to the cam shaft 20, the positioning recess 22*c* of the pulser rotor 22 is fitted to the boss 20*a* of the cam shaft 20, and also the key 22*d* is fitted to the key groove 20*c*, and then a threaded shaft portion 23*b* of the bolt 23 is inserted into the mounting hole 22*b* and threadedly engaged with and fastened to the threaded bore 20*b*. The threadedly engagement of the bolt 23 is performed by using a wrench which is fitted into the hexagonal hole 23*c* in the head portion 23*a* of the bolt 23.

A pulser coil 25 (see FIG. 3), which is opposed to the outer peripheral surface of the pulser rotor 22, is fixedly attached to the cylinder head 11 by a bolt 26. The pulser coil 25 generates a pulse signal at each time the projection 22*a* on the outer periphery of the pulser rotor 22 passes in directly front of the pulser coil 25 (that is, at a predetermined crank position or piston position). The pulser signal is used to operate various control devices of the engine E, such as an ignition device and a fuel injection device.

Figure 5:
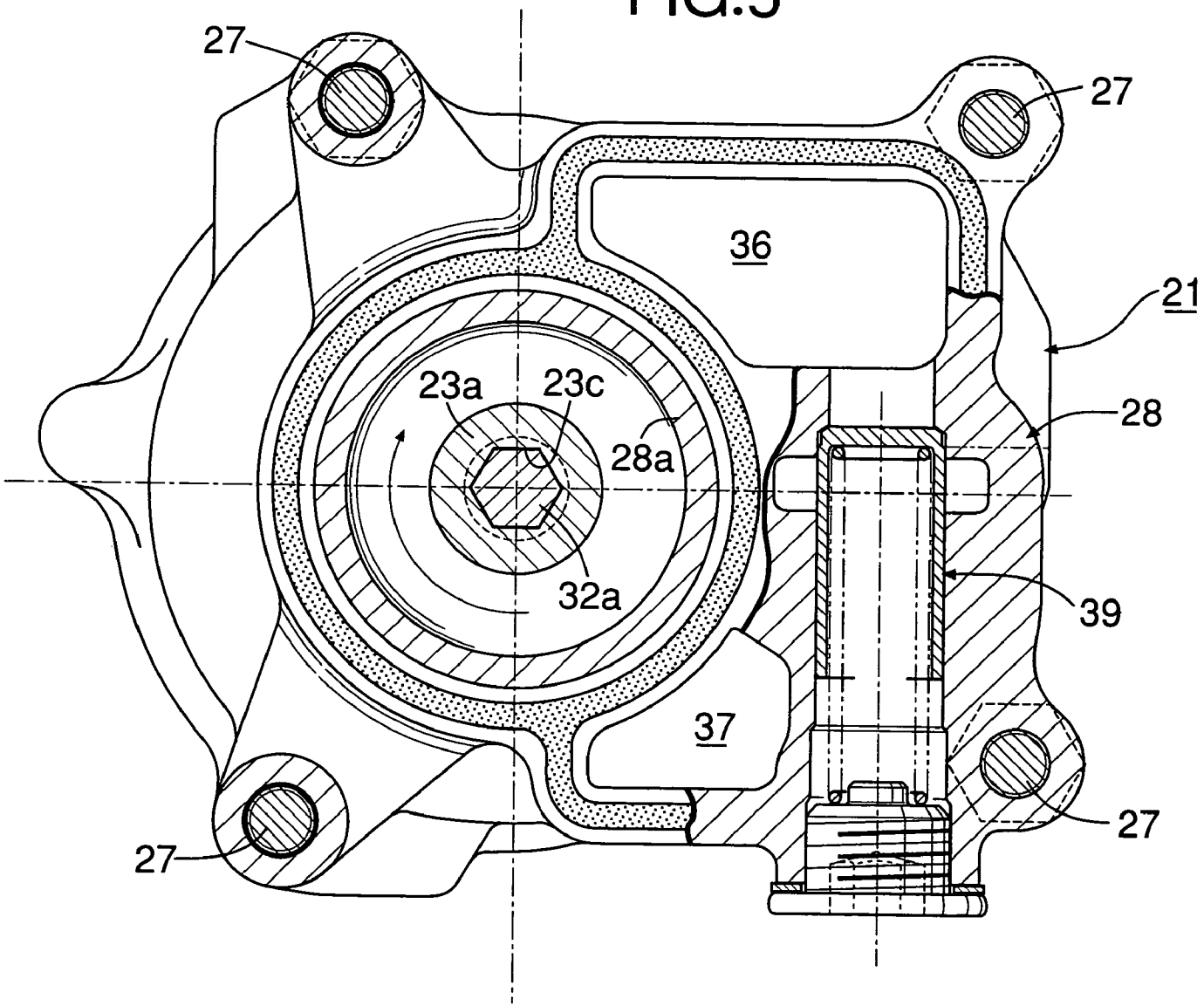
FIG. 5 is a sectional view taken along a line 5-5 of FIG. 2.
Figure 6:
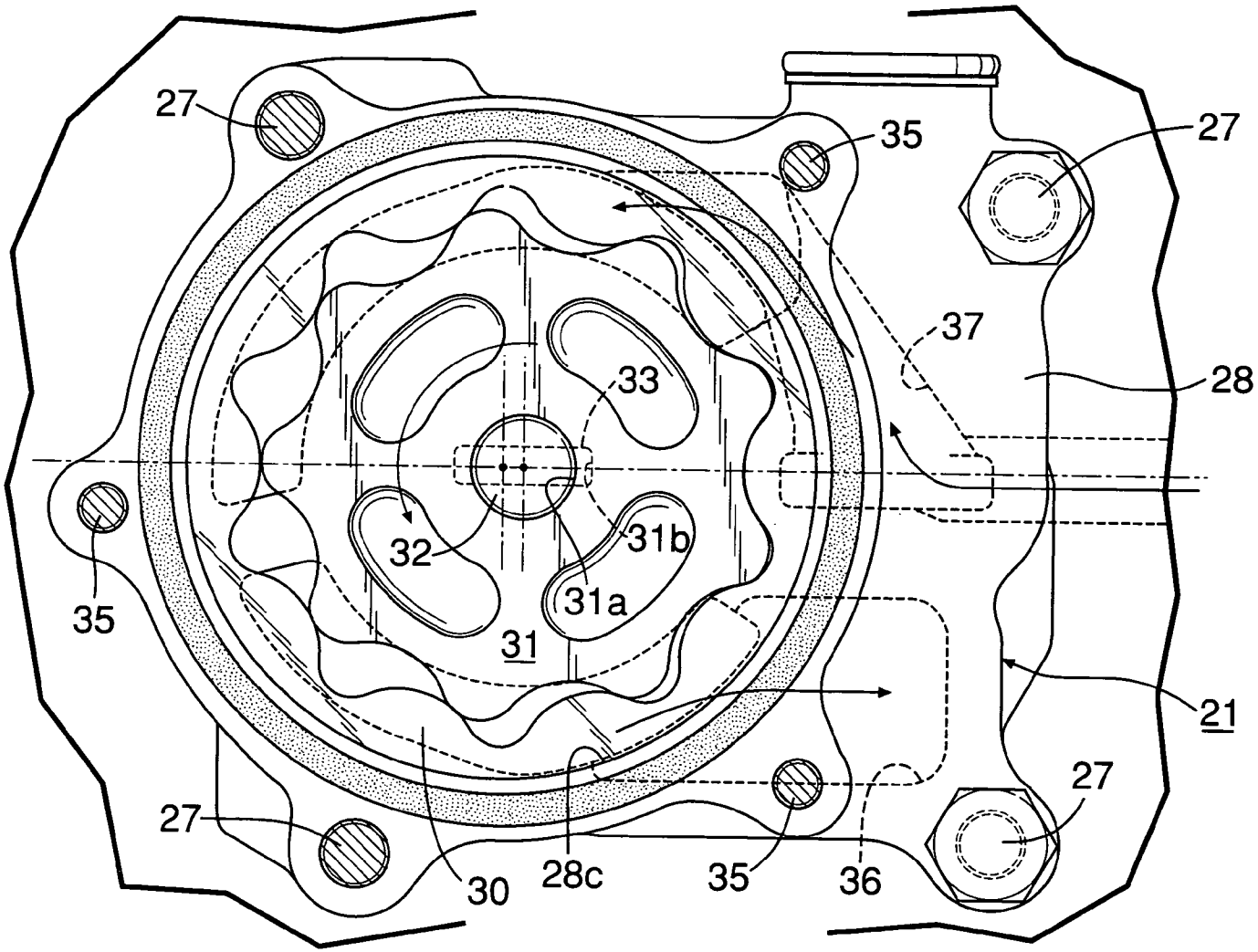
FIG. 6 is a sectional view taken along a line 6-6 of FIG. 2.

In FIGS. 2, 5 and 6, the oil pump 21 is mounted to a lower portion of the cylinder head 11, and is driven by the cam shaft 20 via the bolt 23. The oil pump 21 has a pump housing 28 which is fixedly attached to a lower end surface of the cylinder head 11 by a plurality of bolts 27. The pump housing 28 comprises: a cylindrical positioning portion 28*a*; a bearing hole 28*b* which is arranged coaxially with the cylindrical positioning portion 28*a*; and an annular pump chamber 28*c* which is eccentric by a predetermined distance with respect to the bearing hole 28*b*. The cylindrical positioning portion 28*a* is fitted into a positioning bore 11*a* which is arranged coaxially with the cam shaft 20 and is open to the lower surface of the cylinder head 11. Thus, in a fitted state, the bearing hole 28*b* is also arranged coaxially with the cam shaft 20. The positioning bore 11*a* includes a shoulder 11*b* against which a flange 20*d* formed on the outer periphery of the lower end of the cam shaft 20 abuts. Therefore, the cylindrical positioning portion 28*a* also functions to limit the axial movement of the flange 20*d*, that is, the cam shaft 20, in cooperation with the shoulder 11*b*.

An outer rotor 30 is rotatably fitted into the pump chamber 28*c*. An inner rotor 31 is arranged inside the outer rotor 30 so as to mesh with the outer rotor 30 on one side. The pump shaft 32 is rotatably supported by the bearing hole 28*b* so as to mesh with a shaft hole 31*a* of the inner rotor 31 to drive the inner rotor 31.

A hexagonal shaft portion 32*a* is integrally formed on one end of the pump shaft 32 so as to fit into the hexagonal hole 23*c* in the head portion 23*a* of the bolt 23. A pin-shaped key 33 (see FIG. 4) is provided at the other end of the pump shaft 32 so as to engage with the notch-shaped key groove 31*b* that is open to the shaft hole 31*a* in the inner rotor 31. In this way, the pump shaft 32 is connected to the cam shaft 20 via the bolt 23, and also connected to the inner rotor 31 via the key 33.

A pump cover 34 is attached to a lower surface of the pump housing 28 by a plurality of bolts 35 so as to close the pump chamber 28*c*. The threaded shaft portion 23*b* of the bolt 23 which is threadedly engaged with the cam shaft 20 is formed to cause a load of the oil pump 21 to act as a torque in a direction to fasten the bolt 23 when the cam shaft 20 rotates. Therefore, the oil pump 21 is configured into a trochoidal type.

As shown in FIG. 5 and FIG. 6, the pump housing 28 is provided with a suction port 36 and a discharge port 37: the suction port 36 is connected to a suction tube 38 (see FIG. 1) which is immersed in the oil stored in the oil tank 9; and the discharge port 37 is connected to the lubrication oil passage (not shown) which is in communication with a portion to be lubricated in the engine E. Therefore, in cooperation with the inner rotor 31 and the outer rotor 30, the oil pump 21 can draw up the oil in the oil tank 9 through the suction port 36, and can supply the oil to the portion to be lubricated in the engine E through the discharge port 37. In FIG. 5, the reference numeral 39 designates a pressure relief valve.

Next, the operation of the above embodiment will be described.

During operation of the engine E, the rotation of the valve-operating cam shaft 20 is transmitted to the pulser rotor 22 fixedly attached to the lower end of the cam shaft 20 by the bolt 23, and also to the pump shaft 32 having the hexagonal shaft portion 32*a* which is fitted into the hexagonal hole 23*c* in the head portion 23*a* of the bolt 23, thereby driving the pulser rotor 22 and the pump shaft 32 to rotate. The rotation of the pulser rotor 22 causes the pulser coil 25 to generate pulse signals for operating various control devices, at a predetermined crank position or piston position as described above. Further, the rotation of the pump shaft 32 draws up the oil in the oil tank 9 in cooperation between the inner rotor 31 and the outer rotor 30, and the oil is supplied to the portion to be lubricated in the engine E, as described above.

In this way, the bolt 23 for fixedly attaching the pulser rotor 22 to the end of the cam shaft 20 acts as a joint member to connect the cam shaft 20 to the pump shaft 32 of the oil pump 21, thereby eliminating the need for an joint member exclusively for connecting the oil pump 21 to the cam shaft 20. Thus, it is possible to drive the oil pump 21 by a simple structure including a smaller number of components, thereby reducing the cost of the driving device.

Further, the bolt 23 also functions as a fixing member for fixedly attaching the pulser rotor 22 to the end of the cam shaft 20, thereby reducing the number of components of the engine E as a whole to simplify the structure and also reduce the cost.

Furthermore, the connection structure between the bolt 23 and the pump shaft 32 is provided by a fitting between the hexagonal hole 23*c* for fittingly receiving therein the wrench which is provided in the head portion 23*a* of the bolt 23 and the hexagonal shaft portion 32*a* which is formed at one end of the pump shaft 32. Therefore, it is possible to drive the pump shaft 32 by the cam shaft 20 without reducing the effective supporting surface of the journal portion of the cam shaft 20. Further, because the fitting surface area between the hexagonal hole 23*c* and the hexagonal shaft portion is large, the contact pressure on the fitting portions is suppressed to be low to improve the durability of the fitting portions. No fitting portion is particularly required to be formed in the bolt 23 in order to connect the bolt 23 to the pump shaft 32, thereby contributing to a further simplification of the driving device.

Moreover, because the threaded shaft portion 23*b* of the bolt 23 which is threadedly engaged with the cam shaft 20 is formed to cause the load of the oil pump 21 to act as a torque in the direction to fasten the bolt 23 when the cam shaft 20 rotates, the torque constantly acts on the bolt 23 in the direction to fasten the bolt during the driving of the oil pump 21, thereby preventing the bolt 23 from loosening.

The present invention is not limited to the above described embodiment, and various modifications and changes can be made without departing from the subject matter of the invention. For example, the pump driving device of the present invention is also applicable to driving of a water pump.

What is claimed is:

1. A pump driving device in an engine, driving a pump shaft of a pump mounted to an engine body by a valve-operating cam shaft supported by the engine body, wherein a driving member having a polygonal hole is fixedly mounted at one end of the cam shaft; and a polygonal shaft portion is formed at one end of the pump shaft so as to be fitted into the polygonal hole;

wherein the engine body is formed with a positioning bore coaxial with the cam shaft for housing the driving member therein and a housing for the pump is provided and has a cylindrical positioning portion fitted into the positioning bore; and wherein the cam shaft is formed at an outer periphery of an end thereof with a flange, said positioning bore has a shoulder against which the flange abuts, the flange being clamped between the shoulder and the cylindrical positioning portion.

2. The pump driving device in an engine according to claim 1, wherein the driving member comprises a bolt which is threadedly engaged with the cam shaft; and the polygonal hole comprises a wrench-fitting hole which is formed in a head portion of the bolt.

3. A pump driving device in an engine, driving a pump shaft of a pump mounted to an engine body by a valve-operating cam shaft supported by the engine body, wherein a pulser rotor is fixedly attached to one end of the cam shaft by a bolt which passes through the pulser rotor and is threadedly engaged with the cam shaft; and the bolt and the pump shaft opposed to the bolt are provided with fitting portions, respectively, which are fitted to each other to allow a torque transmission therebetween; and the pulser rotor is clamped and fixed between the cam shaft and the bolt.

4. The pump driving device in an engine according to claim 3, wherein the fitting portion of the bolt comprises a polygonal hole for fittingly receiving therein a wrench which is formed in a head portion of the bolt; and the fitting portion of the pump shaft comprises a polygonal shaft portion which is formed at one end of the pump shaft.

5. The pump driving device in an engine according to claim 3, wherein a threaded shaft portion is formed in the bolt so as to be threadedly engaged with the cam shaft so that the threaded shaft portion causes a load of the pump to act as a torque in a direction to fasten the bolt when the cam shaft rotates.

6. The pump driving device in an engine according to claim 4, wherein a threaded shaft portion is formed in the bolt so as to be threadedly engaged with the cam shaft so that the threaded shaft portion causes a load of the pump to act as a torque in a direction to fasten the bolt when the cam shaft rotates.

7. The pump driving device in an engine according to claim 3, wherein the pulser rotor includes a positioning recess on an upper surface.

8. The pump driving device in an engine according to claim 7, wherein the pulser rotor includes a key integrally projectioningly provided on an inner peripheral surface of the positioning recess.

9. The pump driving device in an engine according to claim 3, further comprising a boss coaxial with the cam shaft and integrally projectingly provided on a lower end surface of the cam shaft.

10. The pump driving device in an engine according to claim 9, wherein the boss includes key groove formed in an outer peripheral surface, and wherein the key is fitted to the key groove.

* * * * *